United States Patent [19]

Kroboth

[11] 4,002,256

[45] Jan. 11, 1977

[54] LIFT ASSEMBLY

[75] Inventor: Richard J. Kroboth, Garfield Heights, Ohio

[73] Assignee: Towmotor Corporation, Mentor, Ohio

[22] Filed: Aug. 28, 1975

[21] Appl. No.: 608,489

[52] U.S. Cl. ..... 214/731; 214/750; 403/328

[51] Int. Cl.[2] ..... B66F 9/14

[58] Field of Search ..... 214/731, 750; 292/175, 292/150; 403/328, 108

[56] References Cited

UNITED STATES PATENTS

| | | | |
|---|---|---|---|
| 649,444 | 5/1900 | Good | 403/108 |
| 657,468 | 9/1900 | Taylor | 403/108 |
| 1,834,909 | 12/1931 | Wilson | 403/328 |
| 2,668,602 | 2/1954 | Cushman | 214/750 |
| 2,975,924 | 3/1961 | Kopanski | 214/750 |
| 3,027,033 | 3/1962 | Schuster | 214/750 |

*Primary Examiner*—Robert J. Spar
*Assistant Examiner*—Lawrence J. Oresky
*Attorney, Agent, or Firm*—Phillips, Moore, Weissenberger, Lempio & Strabala

[57] ABSTRACT

The invention is concerned with an improvement in a carriage-fork assembly. The assembly includes a carriage attachable to a lift truck, the carriage including a plurality of notches along an upper edge thereof. The assembly also includes a plurality of forks, the forks each including a first arm extending generally perpendicularly forwardly from the carriage, a second arm extending upwardly from an end of the first arm adjacent and parallel to the carriage to adjacent the upper edge thereof and a member extending from the first arm over the upper edge and downwardly behind the carriage, the member including a guide sleeve extending upwardly over the upper edge and a bore coaxial with the guide sleeve and extending through the member. Also part of the assembly is a lock rod slidably fitting within the guide sleeve and the bore. A spring is provided for biasing the lock rod downwardly to impel a lower end thereof into the notches. The structure is such that the lock rod can be maintained in a fixed position against the spring with the lower end removed from the notches. The improvement includes a cap affixed over an upper end of the lock rod, the cap has a top and a skirt extending downwardly about the lock rod, an inner surface of the skirt fitting slidingly about an outer surface of the upwardly extending portion of the guide sleeve.

5 Claims, 2 Drawing Figures

LIFT ASSEMBLY

BACKGROUND OF THE INVENTION

1. Field of the Invention

The invention is concerned with an improvement in a liftable assembly. Most particularly the invention is concerned with an improvement in such an assembly wherein a cap is provided which fits over a lock rod which is normally used to fasten a fork to a carriage of a lift truck or the like. The cap serves to protect the lock rod and associated parts from dirt and rust whereby easy operation thereof for long periods of time is assured.

2. Prior Art

Lift trucks and similar load handling devices are well known to the prior art and are generally useful for moving relatively heavy pieces of equipment, materials and the like from one place to another and/or for lifting such equipment, materials and the like to a desired height. Generally, such load handling devices comprise a carriage, said carriage being rideable upwardly within masts which are attached thereto. When the devices are lift trucks they also comprise a powered truck attached to the carriage. Extending from the carriage are generally one or more forks or the like. The forks are generally L-shaped members having a first arm extending forwardly from the carriage and a second arm perpendicular to the first arm extending upwardly parallel to the carriage and further generally having a hook member generally integral therewith and adapted to fit over the upper end of the carriage.

Customarily, same carriages have been provided with a plurality of notches in the upper edge thereof whereby an individual fork can be attached into any one of these notches thus providing a desired positioning of the individual fork or a desired relative positioning of two or more forks. The forks are generally fastened to the notches by means of a lock rod which slidably fits within a guide sleeve and a bore, said bore generally passing through the hook member which fits over the carriage. Such prior art lock rods are generally fastened in place via spring biasing means which normally bias the lock rods so that their lower ends are propelled into the notches atop the carriage. At the upper end of the lock rods there are normally provided handles whereby one can pull upwardly upon the handles and thus upon the lock rods to remove the lock rods from the notches and can then slide the forks to another desired position and thereafter allow the lock rods to be propelled by the spring means into another notch.

A serious problem with prior art carriage-fork assemblies of the nature described above has been that dirt and moisture can easily enter the guide sleeve about the lock rod thereby causing jamming thereof, cutting down on repair-free use thereof and thereby generally interfering with the usefulness of the lift truck or like devices. The present invention is concerned with an improvement which prevents the intrusion of dirt and moisture between the lock rod and the inner surface of the guide sleeve whereby repair and/or replacement of forks, lock rods and the like is greatly reduced.

SUMMARY OF THE INVENTION

The invention is concerned with an improvement in a liftable carriage assembly. The assembly which is improved comprises a carriage attachable to a lift truck or the like and riding within mast means thereon, the carriage including a plurality of notches along an upper edge thereof. The assembly further includes a lifter such as a plurality of forks, the forks each including a first arm extending perpendicularly forwardly from the carriage, a second arm extending upwardly from the first arm adjacent and parallel to the carriage to adjacent the upper edge thereof and a member extending over the upper edge and downwardly behind the carriage, the member including a guide sleeve extending upwardly over the upper edge and a bore coaxial with the guide sleeve and extending through the member. The assembly further includes a lock rod slidably fitting within the guide sleeve and the bore along with means for biasing the lock rod downwardly to impel a lower end thereof into the notches and means for fastening the lock rod in a fixed position against the biasing means with the lower end removed from the notches. The improvement in the assembly comprises a cap affixed over an upper end of the lock rod the cap having a top and having a skirt extending downwardly from the top and about the upper end of the lock rod, and inner surface of the skirt slidingly about an outer surface of the upwardly extending portion of the guide sleeve.

BRIEF DESCRIPTION OF THE DRAWINGS

The invention will be better understood by reference to the figures of the drawing wherein like numbers denote like parts throughout and wherein.

DESCRIPTION OF THE PREFERRED EMBODIMENT

Figure 1:
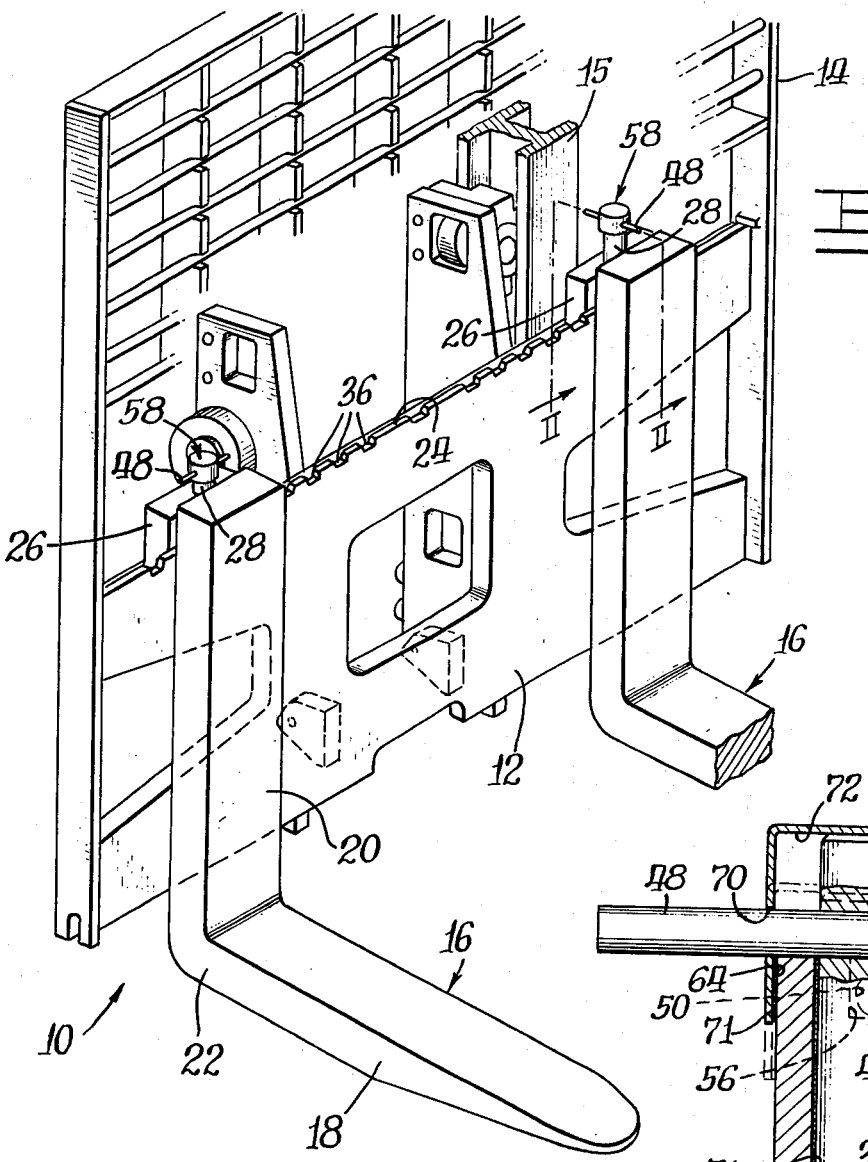
FIG. 1 illustrates a carriage-fork assembly including the improvement of the present invention.

Referring first to FIG. 1, there is illustrated a carriage-fork assembly 10 including the improvement of the present invention. The carriage-fork assembly includes a carriage 12 having a backrest 14 attached thereto (in the usual manner) and ridable upwardly and downwardly in masts 15 one of which is shown in FIG. 1. A lifter, in the embodiment illustrated, a plurality of forks more particularly the two forks 16 also form a part of the assembly 10. The forks 16 each include a first arm 18 extending generally perpendicularly forward from the carriage 12. A second arm 20 of the forks 16 extends upwardly from an end 22 of the first arm 18 adjacent and parallel to the carriage 12. More particularly the second arm 20 extends to adjacent an upper edge 24 of the carriage 12. A member 26 extends from the second arm 20 over the upper edge 24 of the carriage 12 and downwardly therebehind. The member 26 includes a guide sleeve 28 extending upwardly over the upper edge 24 of the carriage and a bore 30 coaxial with the guide sleeve 28 extending through the member 26.

A lock rod 32 slidably fits within the guide sleeve 28 and the bore 30. As illustrated, the diameter of the bore 30 is greater than the inner diameter of the guide sleeve 28 whereby biasing means, in the embodiment illustrated most clearly in FIG. 2, a spring 34 fits about the lock rod 32 as it passes through the bore 30. The spring 34 serves to bias the lock rod 32 downwardly into a respective one of a plurality of notches 36 in the upper edge 24 of the carriage 12. The spring 34 accomplishes this biasing through action against a lower end 38 of the guide sleeve 28 and against a washer 40 slidably held in place within the bore 30 about the lock rod 32 by a pin 42. The washer 40 as will be clear from observation of FIG. 2, fits upon the pin 42, which pin 42 extends from a first hole 44 which passes laterally through the lock rod 32 adjacent a lower end thereof.

Means are provided for fastening the lock rod 32 in a fixed position against the force exerted by the spring 34 with the lower end 46 of the lock rod 32 removed from the notches 36. In the embodiment illustrated the fastening means comprises a combination handle/pin 48 which is affixed within a second hole 50 which passes laterally through the lock rod 32 adjacent an upper end 52 thereof. The guide sleeve 28 includes an upraised portion 54 thereof upon which the handle/pin 48 can be set after the handle/pin 48 has been pulled upwardly upon against the force of the spring 34 and has been rotated so that said handle/pin does not fall into a pair of radially opposed slots 56 defined by the upraised portion 54 at the top of the guide sleeve 28. In the embodiment illustrated in FIG. 2, the handle/pin 48 is illustrated in solid lines as being atop the upraised portion 54 of the guide sleeve 28 and is illustrated in dashed lines as being rotated so that it is within the slots whereby the lower end 46 of the lock rod 32 fits within one of the notches 36.

The improvement of the present invention is found in a cap 58 affixed to the upper end 52 of the lock rod 32. The cap 58 includes a generally disc-like top 60 and a skirt 62 extending downwardly from the top 60 about the lock rod 32 An inner surface 64 of the skirt 62, which skirt is generally cylindrical in shape, fits slidingly about an outer surface 66 of an upwardly portion 68 of the guide sleeve 28. Close tolerances are not needed and generally the inner surface 64 of the skirt 62 will fit loosely about the inner outer surface 66 for easy movement. The skirt 62 includes a pair of apertures 70 opposite each other and in alignment with the second hole 50 through which the handle/pin 48 is affixed. Thus, the handle/pin 48 also serves to hold the cap 58 in place over the guide sleeve 28. Generally lubricant 71 is provided within the improvement of the invention and more particularly about the lock rod 32 and between the inner surface 64 of the skirt 62 and the outer surface 66 of the guide sleeve 28. The lubricant 71 serves to provide for easy operation of an easy sliding up and down of the cap 58 about the guide sleeve 28 and also serves to protect the interior of the mechanism from moisture, dirt and the like.

Figure 2:
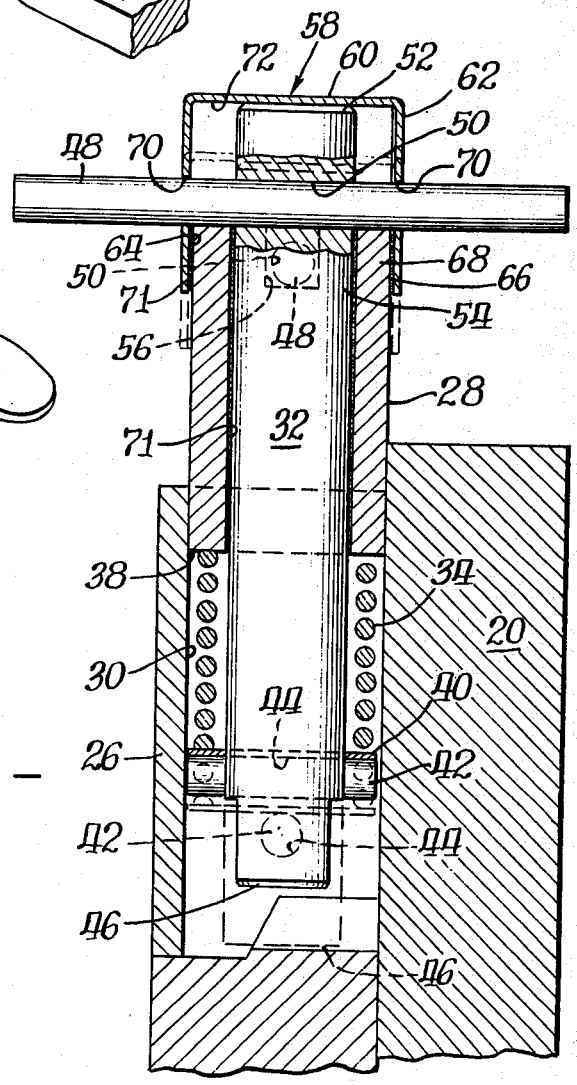
FIG. 2 illustrates a view taken in the direction II — II of FIG. 1 and further illustrates the results of rotating the lock rod which forms a part of the improved carriage-fork assembly of the present invention.

In the embodiment illustrated most clearly in FIG. 2, an inner surface 72 of the cap 58 and more particularly the downward surface of the top 60 of the cap 58 is supportingly contacted by the upper end 52 of the lock rod 32. This serves to provide rigidity and strength to the overall mechanism.

OPERATION

Referring to FIG. 1, the leftmost of the two forks 16 is shown in position with the lock rod 32 having its lower end 46 within one of the notches 36 while the rightmost of the forks 16 is shown with the lower end 46 of its lock rod 42 upraised out of the notches 36. To move a fork 16 from one position to another along the carriage 12, an operator simply places his fingers, one under each extending end of the combination handle/pin 48 and pulls upwardly thereupon to compress the spring 34 and move the lock rod 32 upwardly and out of one of the notches 36. Then, the operator simply rotates the combination handle/pin 48 whereby it is out of line with the slots 56, as for example by rotating it 90° as illustrated in the righthand portion of FIG. 1, and allows the handle/pin 48 to sit upon the upraised portion 54 of the guide sleeve 28. The fork 16 is slid along atop the carriage 12 until the bore 30 is above an appropriate notch 36. Thereafter, the combination handle/pin 48 is once again grasped by the operator underneath each end thereof, the spring 34 is compressed slightly if desired and the handle/pin 48 is rotated so that it can slide into the slots 56 whereby the lower end 46 of the lock rod 32 is fastened into another of the notches 36. It will be noted that both during shifting of the fork 16 from one position to another and during stationary positioning of the fork 16 in any one of the postions available along the carriage 12, the cap 58 serves to protect the lock rod 32 and the guide sleeve 28 from contamination by dirt, moisture and the like, whereby the dirt is prevented from causing jamming and the mositure is prevented from causing rusting with eventual jamming.

While the invention has been described in connection with specific embodiments thereof, it will be understood that it is capable of further modification, and this application is intended to cover any variations, uses or adaptions of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

That which is claimed is:

1. In a liftable assembly comprising a carriage liftably attachable to mast means, the carriage including a notch along an upper edge thereof; a lifter which extends generally perpendicularly forwardly from and generally upwardly and generally parallel to said carriage to adjacent an upper edge of said carriage and a member extending from said lifter over said upper edge and downwardly behind said carriage, said member including a guide sleeve extending upwardly over said upper edge and a bore coaxial with said guide sleeve and extending through said member; a lock rod slidably fitting within said guide sleeve and said bore; means for biasing said lock rod downwardly to impel a lower end thereof into said notch and means for fastening said lock rod in a fixed position against said biasing means with said lower end removed from said notch; and improvement comprising:

a cap affixed over an upper end of said lock rod to move therewith, said cap having a generally disc-like top with a skirt extending downwardly thereabout, an inner surface of said skirt fitting slidingly about an outer surface of said upwardly extending portion of said guide sleeve.

2. An improvement in a liftable assembly as in claim 1, wherein said lock rod includes a hole therethrough adjacent the upper end thereof perpendicular to the axis thereof, said skirt includes a pair of apertures opposite each other and in alignment with said hole and said fastening means comprises a pin affixed through said apertures and said hole and extending laterally from said skirt, and said guide sleeve includes an upraised portion for receiving thereupon said pin.

3. An improvement in a liftable assembly as in claim 2, wherein said pin extends from each of said pair of apertures to form a handle for lifting said lock rod against said biasing means.

4. An improvement in a liftable assembly as in claim 3, including a lubricant between the inner surface of said skirt and the outer surface of said guide sleeve and between the inner surface of said guide sleeve and said lock rod.

5. An improvement in a liftable assembly as in claim 4, wherein an inner surface of said cap is supportedly contacted by the upper end of said lock rod.

* * * * *